United States Patent [19]

Brumbaugh et al.

[11] Patent Number: 4,477,814

[45] Date of Patent: Oct. 16, 1984

[54] DUAL MODE RADIO FREQUENCY-INFRARED FREQUENCY SYSTEM

[75] Inventors: Charles T. Brumbaugh, Fullerton; Robert L. Pittenger, Orange; Robert M. Klees, Costa Mesa, all of Calif.

[73] Assignee: The United States of America as represented by the Secretary of the Air Force, Washington, D.C.

[21] Appl. No.: 404,096

[22] Filed: Aug. 2, 1982

[51] Int. Cl.[3] ..... H01Q 3/14; H01Q 21/28; H01Q 19/18

[52] U.S. Cl. ..... 343/725; 343/6 ND; 343/770

[58] Field of Search ..... 343/6 ND, 840, 725, 343/729, 770

[56] References Cited

U.S. PATENT DOCUMENTS

| | | | |
|---|---|---|---|
| 2,895,127 | 7/1959 | Padgett | 343/840 |
| 2,972,743 | 2/1961 | Svensson et al. | 343/6 ND |
| 3,114,149 | 12/1963 | Jessen | 343/6 ND |
| 3,165,749 | 1/1965 | Cushner | 343/6 ND |
| 4,247,858 | 1/1981 | Eichweber | 343/729 |

*Primary Examiner*—Eli Lieberman

*Attorney, Agent, or Firm*—Donald J. Singer; Jacob N. Erlich

[57] ABSTRACT

A combined RF/IR system in which a common surface is used in the dual modes of radiating and absorbing RF energy and of reflecting and focusing IR energy. The common surface is structured, configured, and used as the slotted array antenna for the RF energy and as the primary mirror of a Cassegrain optical subsystem for the IR energy.

7 Claims, 4 Drawing Figures

DUAL MODE RADIO FREQUENCY-INFRARED FREQUENCY SYSTEM

STATEMENT OF GOVERNMENT INTEREST

The invention described herein may be manufactured and used by or for the Government for governmental purposes without the payment of any royalty thereon.

BACKGROUND OF THE INVENTION

This invention relates to radio frequency and infrared frequency seeker systems, and, more particularly, to a dual mode radio frequency-infrared frequency (hereafter referred to as "RF/IR" seeker system in which a common surface is configured and structured to radiate and absorb radio frequency (hereinafter referred to as "RF") energy and to reflect and focus infrared frequency (hereinafter referred to as "IR") energy.

Electro-optical seeker systems (such as an IR system) offer excellent tracking capabilities due to their high resolution, i.e., narrow beamwidth. However, these systems have relatively short range capability in adverse weather. RF systems, on the other hand, have a long range all-weather capability, but cannot provide the tracking accuracy of the electro-optical system. A dual mode RF/IR system would provide the advantages of both technologies. However, RF and IR systems utilize drastically different components, materials, and physical law values. Many of the requirements appear to be mutually exclusive. These difficulties have prevented the potential performance advantages inherent in the combination of these technologies from being realized.

SUMMARY OF THE INVENTION

The instant invention overcomes the aforementioned difficulties of the prior art and, thereby, constitutes a significant advance in the state-of-the-art. The instant invention overcomes these difficulties by using, in a combined RF/IR seeker system, a frequency-separating common surface. This common surface is configured and structured to radiate and absorb RF energy and to reflect and focus IR energy. Slots in the common surface serve to produce a slotted array RF energy antenna; whereas, the same surface functions as the primary mirror of a Cassegrain IR energy optical subsystem.

Accordingly, it is an object of the instant invention to provide a dual mode RF/IR energy seeker system.

It is another object of this invention to provide such an RF/IR energy seeker system in which the surface of a constituent component of the RF and IR portions of the system is common to both portions.

It is still another object of the instant invention to provide such an RF/IR energy seeker system in which the common surface functions as the antenna of the RF portion of the system and also functions as the primary mirror of a Casssegrain optical subsystem of the IR portion of the system.

It is a further object of this invention to provide such an RF/IR energy seeker system in which the aforementioned common surface is configured and structured to radiate and absorb the RF energy, and to reflect and focus the IR energy.

It is a still further object of the instant invention to provide such an RF/IR energy seeker system in which the RF sensor and the IR sensor utilize the same gimbal means, are concise, and always "look" at the same point in space, thereby simplifying boresight alignment and hand-off (i.e., switching) from one sensor to the other.

It is yet still another object of this invention to provide such an RF/IR energy seeker system in which the RF portion and the IR portion of the combined system each use a full aperture area.

These objects of the instant invention, as well as other objects related thereto (such as simplicity of structure, and reliability of use) will become readily apparent after a consideration of the description of the instant invention, together with reference to the contents of the Figures of the drawing.

DETAILED DESCRIPTION OF THE DRAWING

DESCRIPTION OF THE PREFERRED EMBODIMENT

Figure 1:
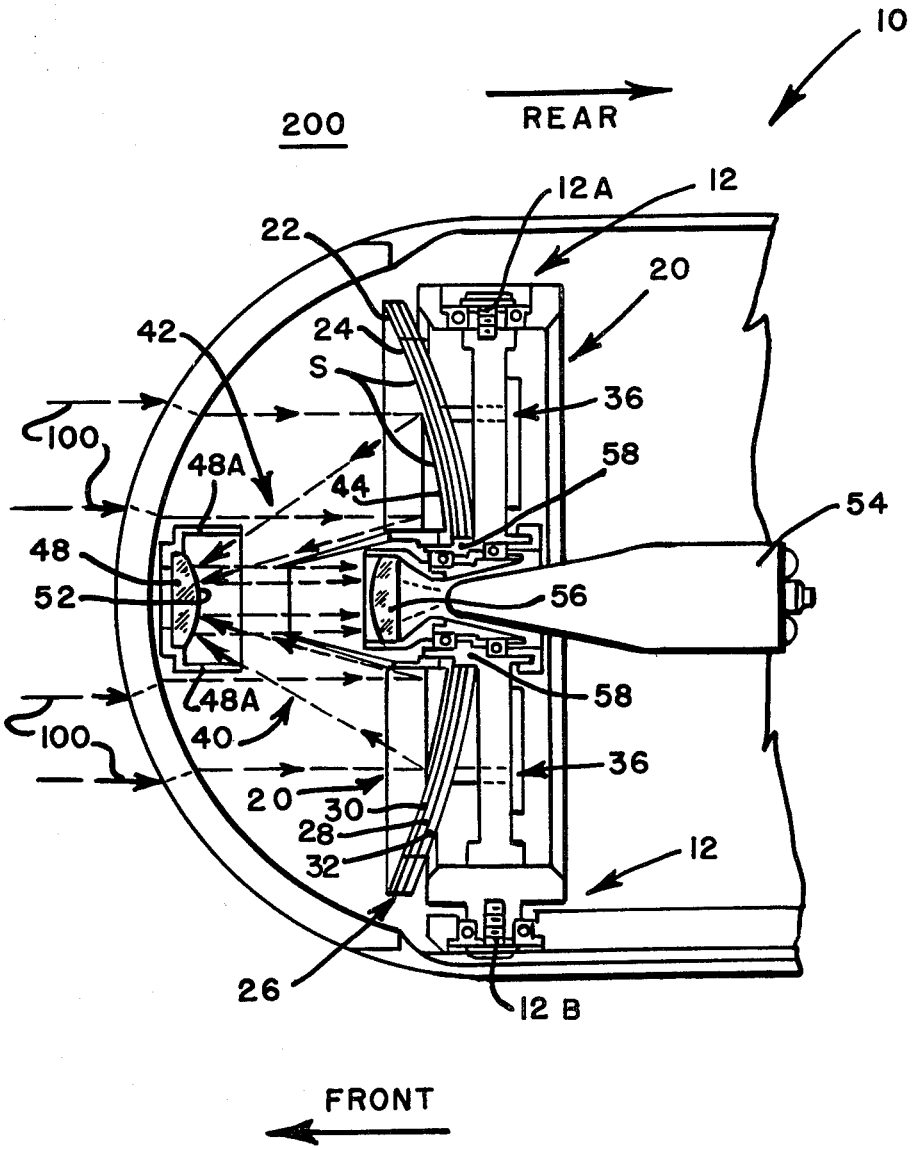
FIG. 1 is a side-elevation view, in simplified pictorial and schematic form, partially in cross section and partially fragmented, of a preferred embodiment of the instant invention.

With reference to FIG. 1, therein is shown a preferred embodiment 10 of the instant invention, a dual mode RF/IR energy seeker system.

Figure 2:
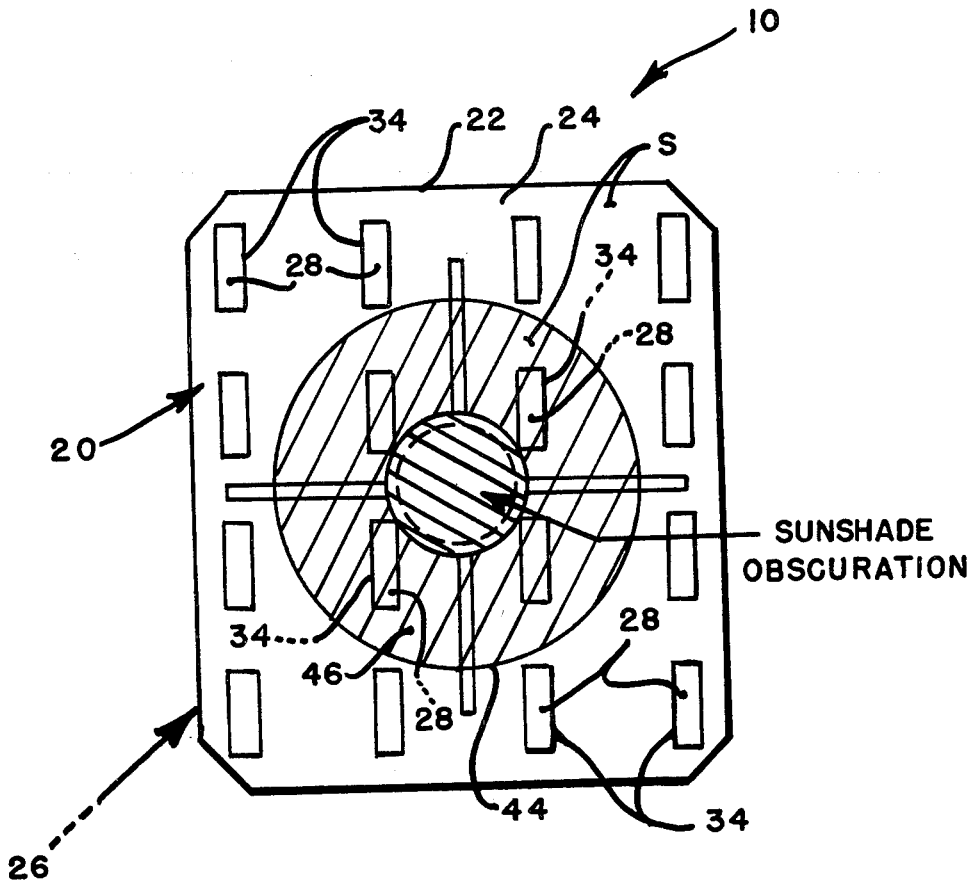
FIG. 2 is the front view, in simplified pictorial and schematic form, of the combined RF antenna and IR primary mirror, showing that a portion thereof is obscured in use.
Figure 2:
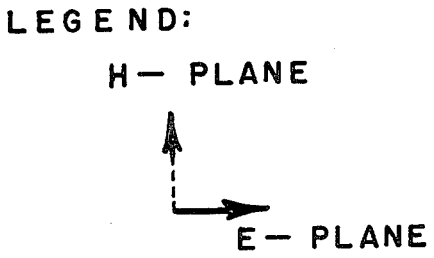

The preferred embodiment 10, in the most basic and generic structural form, comprises: a means (generally designated 20) for seeking, sensing, and absorbing RF energy, with this means mounted on a gimbal means 12 and including an RF antenna 22 having a surface 24; and, means (generally desigated 40) for seeking, sensing, reflecting, and focusing IR energy 100, with this means 40 also mounted on gimbal means 12 and including a Cassegrain IR optical subsystem 42 having a primary mirror 44 with a surface 46, FIG. 2, and with this means 40 operably associated with RF energy means 20.

It is here to be noted that IR energy means 20 and RF energy means 40 are coaxial and always "look" at the same point (not shown) in their environment 200 (i.e., space), because they are mounted on the same gimbal means 12 which comprises an inner gimbal member 12A and an outer gimbal member 12B.

It is here also to be noted that the surface 24 of the RF antenna 22, and the surface 46 of the primary mirror 44 of the IR optical subsystem 42, comprise one (and the same) surface. Therefore, the surface is common to both means 20 and 40, and hereinafter that surface will be referred to as "S".

Now, with reference to FIGS. 1 and 2, only a centrally located portion of the common surface S is used as the IR reflector 44, i.e., the primary mirror of the Cassegrain subsystem 42, as can be seen in FIG. 2. The primary mirror area 44 is polished and aluminized (except for the four slots therein, FIG. 2, which will be discussed later herein) to reflect the IR energy. The Cassegrain subsystem 42 also includes a secondary mirror 48, FIG. 1, in optical alignment with the primary mirror 44. The secondary mirror 48, FIG. 1, is made of any suitable rigid RF-transmissive plastic, and the reflective surface 52 of the secondary mirror is covered with any suitable IR-reflective/RF transmissive dielectric coating.

With reference to FIG. 1, the IR means 40 includes an IR frequency energy sensor 54 with a rotating off-axis image/objective lens 56 onto which is reflected the IR frequency energy 100, FIG. 1, by an afocal system which is formed by the primary mirror 44, FIGS. 1 and 2 and the secondary mirror 48, FIG. 1.

Figure 3:
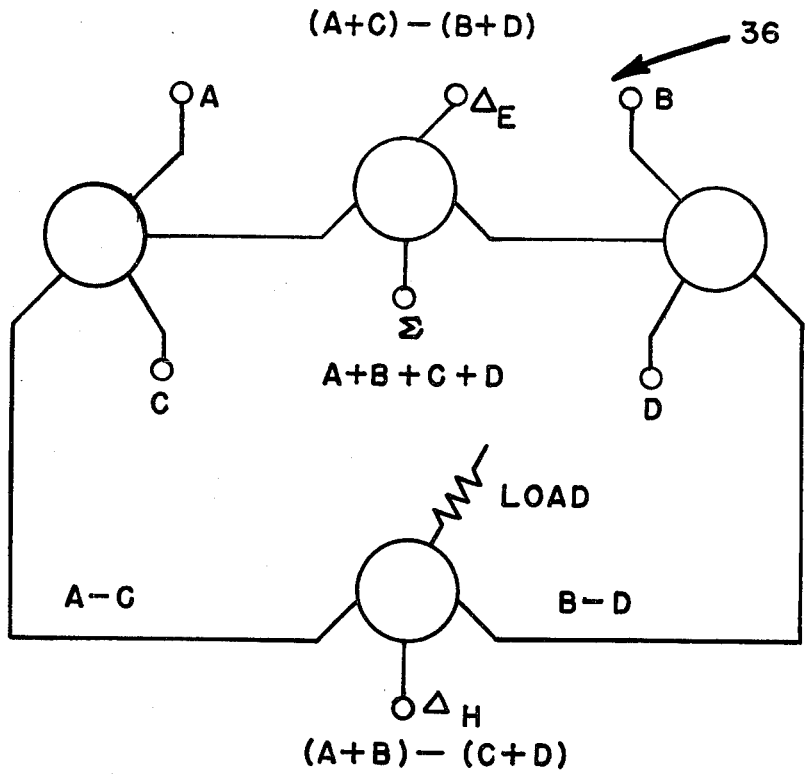
FIG. 3 is a schematic representation of a stripline monopulse beam forming network component of the preferred embodiment.
Figure 3:
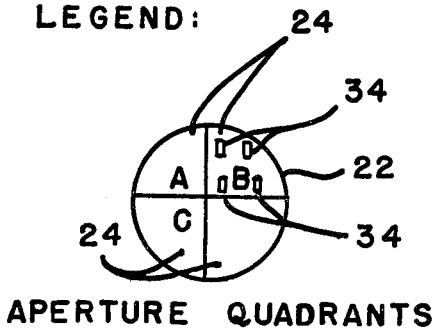
Figure 3:
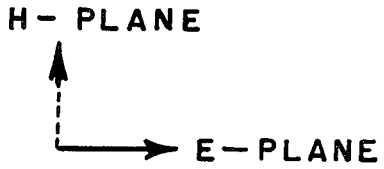

Now, with reference to FIGS. 1–4, inclusive, the surface S, FIGS. 1 and 2, which is common to the RF means 20 and the IR means 40 actually comprises a strip transmsission line assembly 26 that is configured in a parabolic shape, as best seen in FIG. 1. This assembly 26 comprises a strip transmission line 28 that is suitably disposed between a front ground plane 30 and a rear ground plane 32, as can best be seen in FIG. 1. The front ground plane 30 has a plurality of slots 34, FIG. 2, therethrough, such that the slotted array RF antenna 22 is formed. The antenna 22 includes: the slots 34 grouped into aperture quadrants (such as A, B, C, and D, as shown in the legend of FIG. 3, for illustrative purposes); a monopulse beam forming network, such as 36, FIG. 3, in electrical connection with the quadrants and the slots 34 therein; and delay lines, such as 38, FIG. 4, in electrical connection with the monopulse beam forming network 36. With regard to FIG. 4, the opening 58 in the primary mirror 44 for the rotating off-axis image-/objective lens 56 also is shown.

It is here to be noted that the four slots 34 which are within the area of the primary mirror 44, FIG. 2, and which were hereinbefore referred to with regard to that mirror 44, are covered with a suitable dielectric to reflect the IR and to transmit the RF.

MANNER OF OPERATION AND OF USE OF THE PREFERRED EMBODIMENT

The manner of operation, and of use, of the preferred embodiment 10, FIGS. 1–4, inclusive, of the instant invention can be easily ascertained by any person of ordinary skill in the art from the foregoing description, coupled with reference to the contents of the Figures of the drawing.

For others, the following explanation is given. The instant invention, as represented by the preferred embodiment 10, utilizes a unique dual-mode common surface S, FIGS. 1 and 2, to collect and separate the two widely separated electromagnetic frequencies, i.e., the RF and IR. Separation of the two frequencies allows each frequency to be detected and treated in the way that is nearest the optimum for its particular technology. Specifically, the common surface S is structured and configured to radiate and absorb the RF energy, and to reflect and focus the IR energy. The common surface S is shaped and functions as the primary mirror 44 of the Cassegrain optical subsystem 42 of the IR means 40; and, the common surface S also is shaped (parabolically and with slots 34 therein) and functions as the slotted array RF antenna 22 of the RF means 20.

The surface 46 of the primary mirror 44 reflects and focuses IR energy 100, and out of band RF energy, toward the secondary mirror 48. To minimize the affect of the focused out of band RF energy on the IR detector 54, the secondary mirror 48, its sunshade 48A in FIG. 1, and the supporting structure are made of any suitable RF-transmissive plastic. The reflective surface 52 of the secondary mirror 48 is covered with the same IR-reflective/RF-transmissive dielectric coating as covers the slots 34 in the surface 46 of the primary mirror 44. Thus, only the IR energy 100 is reflected from the secondary mirror 48 toward the focal plane. The two IR mirrors 44 and 48, as shown in FIG. 1, form an afocal system which collimates and reflects its parallel rays onto the objective lens 56 of the IR sensor 54,. The lens 56 is rotated by suitable conventional means (not shown) off-axis to cause mutation of the scene (i.e., the image) over a stationary reticle which is in the focal plane. The energy that passes through the recticle is modulated by it, and then impinges upon the detector 54.

Figure 4:
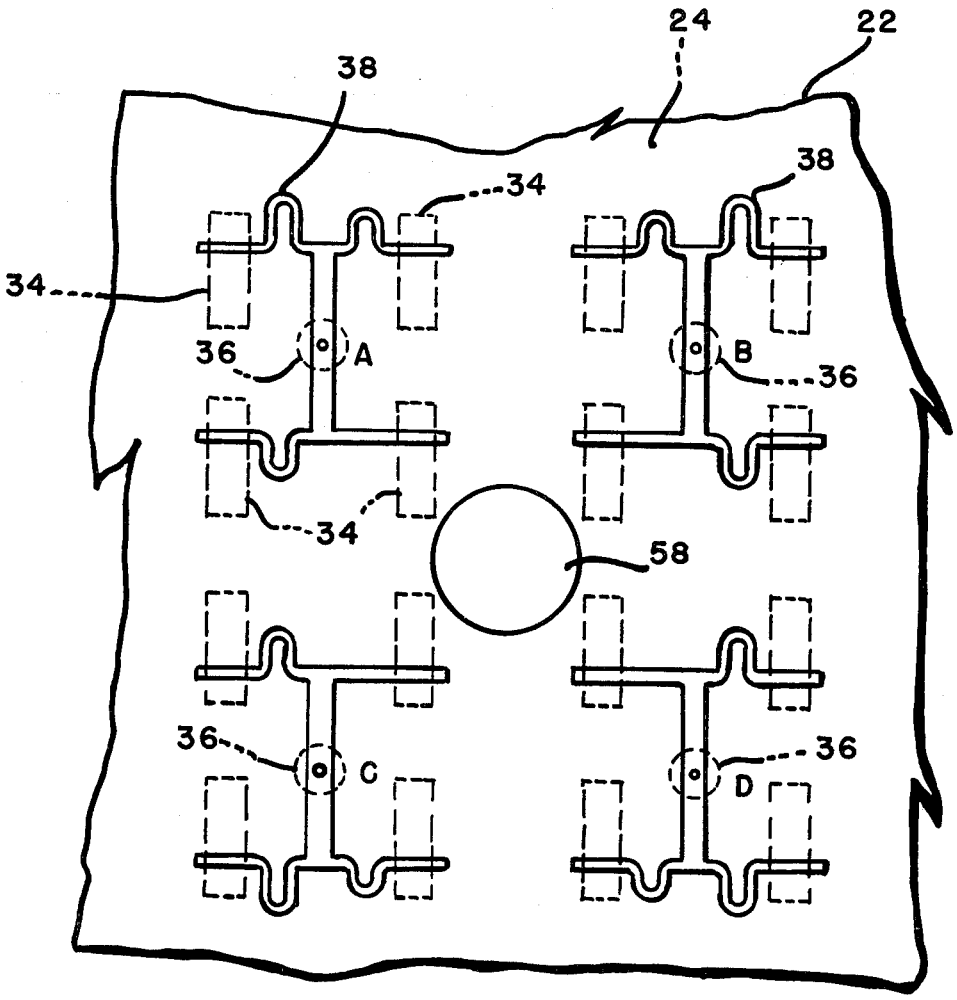
FIG. 4 is a pictorial representation of the curved surface delay lines used in the preferred embodiment.

The RF means 20 utilizes the common surface S as a uniquely curved strip transmission line assembly slotted array antenna 22, with the radiating slots 34 being in the curved metallic strip transmission line assembly front ground plane 30 to form the slotted array. The slots 34 are grouped into quadrants A, B, C, and D, FIG. 3, and are electrically connected to the monopulse network 36, FIG. 3, for both transmitting and receiving. Delay lines, such as 38, FIG. 4, are electrically connected to the monopulse network 36 to correct for the phase error which is introduced by positioning the radiating slots 34 in the curved common surface S, which is also the surface 24 of the RF antenna 22.

CONCLUSION

It is abundantly clear from all of the foregoing, and from the contents of the Figure of the drawing, that the stated objects of the instant invention, as well as other objects related thereto, have been achieved.

It is to be noted that, although there have been described and shown the fundamental and unique features of the instant invention, as applied to a preferred embodiment 10, nevertheless various other embodiments, variations, adaptations, substitutions, additions, and the like may occur to and can be made by those of ordinary skill in the art.

What is claimed is:

1. A dual mode radio frequency-infrared frequency seeker system, comprising:

a. means for seeking, sensing, radiating and absorbing radio frequency energy, wherein this means is mounted on a gimbal means and includes a radio frequency antenna having a surface; and b. means for seeking, sensing, reflecting, and focusing infrared frequency energy, wherein this means is also mounted on said gimbal means and includes a Cassegrain infrared frequency optical subsystem having a primary mirror with a surface, and wherein this means is operably associated with and is in coaxial relationship with said means for seeking, sensing, radiating and absorbing radio frequency energy;

and wherein said surface of said radio frequency antenna and said surface of said primary mirror are the same surface and form a surface common to both said means, said surface common to both said means defining a strip line transmission assembly, said strip line assembly including a front ground plane and a rear ground plane and being configured in a parabolic shape and having a stip transmission line disposed between said front ground plane and said rear ground plane.

2. A dual mode radio frequency-infrared frequency seeker system, as set forth in claim 1, wherein said front ground plane has a plurality of slots therethrough such that a slotted array radio frequency antenna is formed.

3. A dual mode radio frequency-infrared frequency seeker system, as set forth in claim 2, wherein said slotted array radio frequency antenna includes:

a. said slots through said front ground plane grouped into quadrants;

b. a monopulse beam focusing network in electrical connection with said quadrants; and c. delay lines in electrical connection with said monopulse beam forming network.

4. A dual mode radio frequency-infrared frequency seeker system, as set forth in claim 3, wherein only a centrally located portion of said common surface comprises said primary mirror, and wherein some of said plurality of slots in said front ground plane are located within said centrally located portion of said common surface, with these slots covered with an infrared frequency-reflective/radio frequency-transmissive dielectric coating.

5. A dual mode radio frequency-infrared frequency seeker system, as set forth in claim 4, wherein said Cassegrain infrared frequency optical subsystem has a secondary mirror in optical alignment with said primary mirror, and is made of rigid radio frequency transmissive material.

6. A dual mode radio frequency-infrared frequency seeker system, as set forth in claim 5, wherein said secondary mirror has a reflective surface which is covered with the same infrared frequency-reflective/radio frequency-transmissive dielectric coating as covers said slots in said centrally located portion of said common surface.

7. A dual mode radio frequency-infrared frequency seeker system, as set forth in claim 6, wherein said means for seeking, sensing, reflecting, and focusing infrared frequency energy further includes an infrared frequency energy sensor with a rotating off-axis image-/objective lens onto which said lens is reflected infrared frequency energy by an afocal system formed by said primary mirror and said secondary mirror.

* * * * *